US006273762B1

(12) United States Patent
Regnier

(10) Patent No.: US 6,273,762 B1
(45) Date of Patent: Aug. 14, 2001

(54) CONNECTOR MODULE RETAINER ESPECIALLY SUITABLE FOR WAFER CONNECTORS AND CONNECTOR ASSEMBLY UTILIZING SAME

(75) Inventor: Kent Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/433,412

(22) Filed: Nov. 3, 1999

(51) Int. Cl.[7] ..... H01R 13/502; H01R 13/648; H01R 13/514; H01R 9/22

(52) U.S. Cl. ..... 439/701; 439/608; 439/709

(58) Field of Search ..... 439/701, 608, 439/716, 709, 712, 714, 532, 599, 596, 603

(56) References Cited

U.S. PATENT DOCUMENTS

| | | | | |
|---|---|---|---|---|
| 3,496,521 | * | 2/1970 | Hohorst | 339/95 |
| 4,171,861 | * | 10/1979 | Hohorst | 439/94 |
| 4,735,583 | | 4/1988 | Rudy, Jr. et al. | 439/350 |
| 4,984,992 | | 1/1991 | Beamenderfer et al. | 439/108 |
| 5,090,920 | | 2/1992 | Casey | 439/540 |
| 5,122,077 | | 6/1992 | Maejima et al. | 439/398 |
| 5,385,490 | | 1/1995 | Demeter et al. | 439/579 |
| 5,795,191 | * | 8/1998 | Preputnick et al. | 439/608 |
| 6,027,380 | * | 2/2000 | Hanning et al. | 439/716 |

* cited by examiner

*Primary Examiner*—Paula Bradley
*Assistant Examiner*—Edwin A. León
(74) *Attorney, Agent, or Firm*—A. A. Tirva

(57) ABSTRACT

A retainer and connector system serves to reliably hold together and align a series of thin connector modules, such as wafer connectors, into an overall unit formed from the individual connector modules. The side edges of each of the connector modules have a pair of cavities formed therein. A retainer member is provided having a length equal to the thickness of the connector unit. The retainer member has two opposing ends, each with first and second engagement members disposed thereon. The first engagement members are inserted into the first engagement cavities and rotated toward the connector modules until the second engagement members enter and engage the second engagement cavities.

20 Claims, 4 Drawing Sheets

CONNECTOR MODULE RETAINER ESPECIALLY SUITABLE FOR WAFER CONNECTORS AND CONNECTOR ASSEMBLY UTILIZING SAME

BACKGROUND OF THE INVENTION

The present invention relates generally to connectors and multiple-unit connector assemblies, and more particularly, to a retainer for aligning and maintaining a plurality of connector modules, such as wafer connectors, together as a unit.

In the field of telecommunications and in other electronic fields, cable assemblies are used to connector one electronic device to another. In many instances, the cable assemblies have at one or more of their ends, a plurality of connector modules, each of which serves to connect a plurality of individual wires to an opposing connector, such as a pin connector. It is desirable to somehow connect the individual connector modules together so that they may connected and disconnected from an opposing connector as a single unit, in order to save in time in making the connections, as well as for other reasons.

Structures for attaining these aims are known in the art, but tend to be large and bulky as compared to the overall size of the connector modules. Such structures are shown in U.S. Pat. No. 5,385,490, issued Jan. 31, 1995 in which a two-part retainer is used. The two part retainer in this patent surrounds the entire exterior surface of the connector modules and thus increases the overall size of the connector modules, when assembled together as a unit inside of the retainer. This may force the use of a different design for the opposing connector which the unit of connector modules are intended to engage. A similar retainer housing is described in U.S. Pat. No. 4,984,992, issued Jan. 15, 1991. This retainer also defines a hollow interior into which a plurality of connector modules are inserted. The retainer surrounds the exterior surfaces of the connector modules and therefore increases the overall size and mass of the connector module unit significantly.

The present invention is therefore directed to a novel and unique retainer assembly for use with a plurality of connector modules, preferably wafer connectors, that does not increase the overall size of the unit of connector modules and which reliably aligns the connector modules together and maintains them in a unitary fashion.

SUMMARY OF THE INVENTION

Accordingly, it is a general object of the present invention to provide an improved retainer for use with forming a unit of a plurality of connector modules that aligns the connector modules and maintains them in a particular orientation within the unit.

Another object of the present invention is to provide a retainer for holding a series of connector modules such as wafer connectors together as a unit, by engaging the exterior surfaces of the wafer connectors without increasing the overall size of mass of the unit of connectors.

Yet another object of the present invention is to provide a retainer for aligning and holding together, a plurality of thin connector modules together wherein the retainer has two opposing engagement ends that engage two different portions of the wafer connectors and which is insertable into one set of cavities formed on the exterior surfaces of the connector modules and rotatable when engaged in order to exert a alignment effort on the connector modules and in order to bring the other end of the retainer into engagement with another set of cavities also formed on the exterior surfaces of the connector modules.

A still further object of the present invention is to provide a retainer, or stiffener, that is used to hold a plurality of high speed cable connectors together by way of engaging the individual cable assembly connectors, each of the connectors having two engagement cavities formed along at least one side thereof, the engagement cavities being spaced apart from each and the retainer having a length that is approximately equal to the spacing between the cavities, the retainer further having two opposing engagement ends, a first engagement end thereof have a rounded engagement member that is insertable into a corresponding first engagement cavity of the connector and a second engagement end that is insertable into and engageable with a corresponding second engagement cavity of the connector, the first engagement end being rotatable within the connector first engagement cavity.

The present invention accomplishes these and other objects by way of its unique structure. A retainer member is provided that has a length equal to a corresponding width of the assembly of connectors and it includes a plurality of individual retaining elements formed on it, each individual retainer element being positioned in order to engage the exterior surface of a corresponding individual connector. The retainer member, in the preferred embodiment, takes the form of an elongated member having two opposing engagement ends or edges that extend lengthwise of the retainer member and which engage two corresponding engagement portions disposed on each individual connector module, which in the preferred embodiment, take the form of engagement cavities.

The two engagement ends of each retainer element are differently configured. One engagement end of each retainer element is partially rounded and is adapted to fit into a semi-circular cavity formed on each connector and the engagement end includes a outstanding shoulder portion that is adapted to engage with a corresponding opposing shoulder, or stop portion formed in the semi-circular engagement cavity. The rounded profile of the engagement end and the semi-circular profile of the engagement cavity cooperatively permit the first engagement end to be inserted and rotated within the first engagement cavity of the connectors. This action exerts a slight alignment force on all of the connector elements to align them as a block and facilitates the engagement of the retainer member second end into the connector element second engagement cavities.

The second engagement cavity formed on each connector element includes a generally rectangular cavity having an undercut formed therein that defines another shoulder or stop. The second engagement end of the retainer member includes a flexible latch member having a latching hook formed thereon in opposition to the stop of the second engagement cavity. Thus, when the retainer member is rotated after insertion into the first engagement cavity, the latching end is urged into the second engagement cavity and into engagement with the stop therein.

The round configuration of the retainer member first end permits the retainer member to be initially located in the first engagement cavities and then rotated. The rotational movement serves to align the plurality of connector elements lengthwise of the connector elements, while lugs that may be formed in the one or both of the two engagement cavities of the connector elements may be engaged by corresponding opposing slots formed in the engagement ends of the retainer member so that the connector elements are thereby aligned in widthwise of the connector elements, and transverse to the lengthwise direction.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENTS

Figure 1:
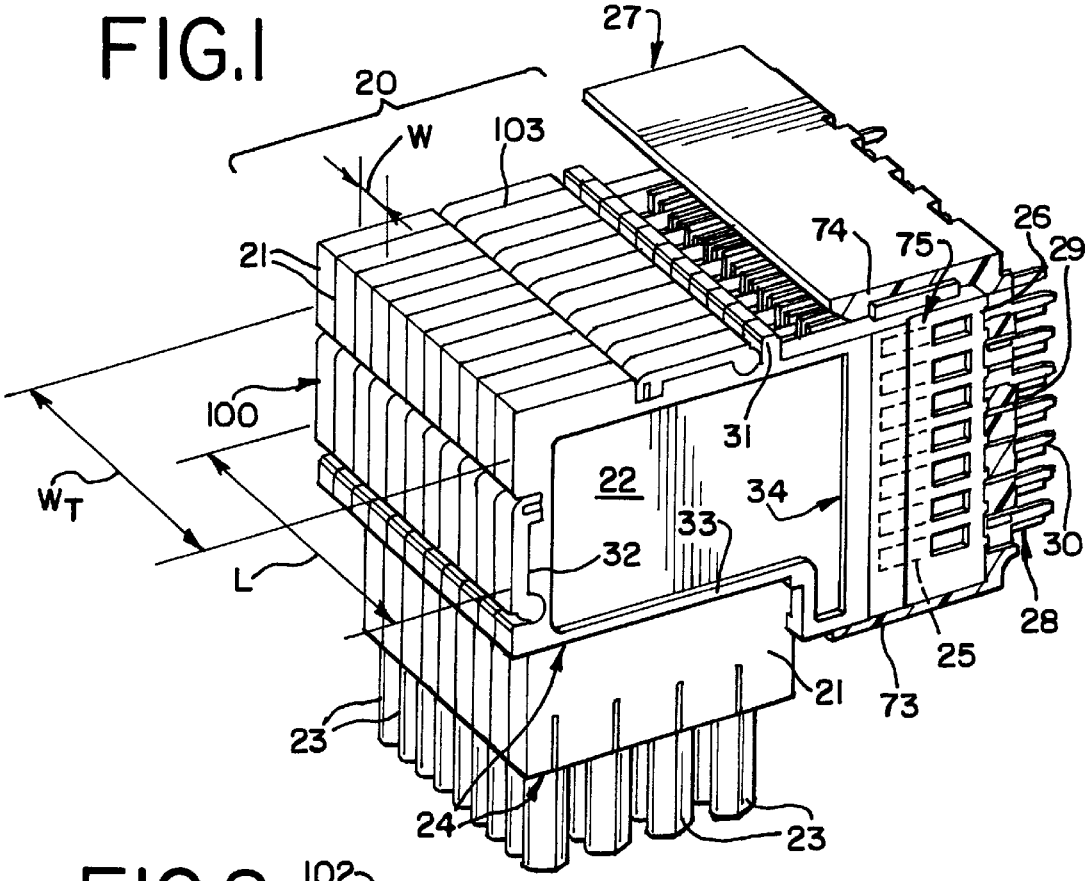
FIG. 1 is a perspective view of a wafer connector assembly utilizing a retainer member constructed in accordance with the principles of the present invention.

FIG. 1 illustrates a connector assembly 20 in the form of a "block" or "unit" that is made up of a plurality of individual connector elements, or modules 21. Each such connector element 21 has a relatively thin connector body 22, and hence the name "wafer"connector has been commonly applied to such connector elements in the art. Each connector element 21, as is known in the art, has a connector body 22 through which conductive elements (not shown) extend in order to provide conductive paths between individual connector cables 23 disposed at one end 24 of the connector element 21, each of which typically contains a pair of conductive wires, and a like number of conductive terminals 25 (shown in phantom) that are typically embedded in another end 26 of the connector element 21 spaced apart from the cable end 24 of the connector element 21. This engagement, or terminal end 26, is typically received within an opposing connector member 27, such as a pin header, that is typically mounted to a backplane (not shown). The opposing connector member 27 typically has a plurality of conductive pin terminals 28 that extend on both sides of a base 29 of the opposing connector body, certain ends 30 of which are received within corresponding openings in the backplane member and the other ends of which are received within openings formed in the terminal ends 26 of the connector elements 21 and which engage the interior terminals 25 thereof. Each connector element 21 may be considered as having a number of distinct sides, faces or edges with four such sides 31, 32, 33 & 34 being shown in FIG. 1.

It is important to retain the connector elements 21 together in alignment, as a single unit, or block, of connector elements 21 in order to facilitate the insertion thereof into an opposing connector member 27 and connection of the conductive terminals 25 to opposing terminals 28. The small size of these type of connector elements and the tolerances involved in making their conductive terminals 25 are some of the reasons why alignment of such wafer connector assemblies is important, because when aligned, it is easier to insert and connector an aligned assembly without fear of misalignment of the terminals or wafer connector elements.

The present invention provides a simple, reliable and inexpensive means for aligning a series of wafer, or other connector elements that may be trimmed to an appropriate size to match the corresponding size of an assembly 20 of wafer connector elements 21 by an installer, and which aligns and retains a plurality of wafer connector elements 21 together as a single mass in a preselected spacing. This is accomplished by way of a connector retainer member 100 that engages the plurality of wafer connector elements 21. As illustrated in FIG. 1, the retainer members 100 of the present invention may be used on two distinct, but adjacent, sides 31, 32 of the wafer connector assembly 20, although other constructions are contemplated, such as the use of a single retainer member 100 or two such retainer members 100 being used along one side of the wafer connector element 21, or the cables 23 of the connector elements being oriented along one side 32 opposite the terminal end 34 of the connector elements 21 and the retainer members 100 being used on the two remaining opposing sides 31 & 33 of the connector elements 21.

Figure 2:
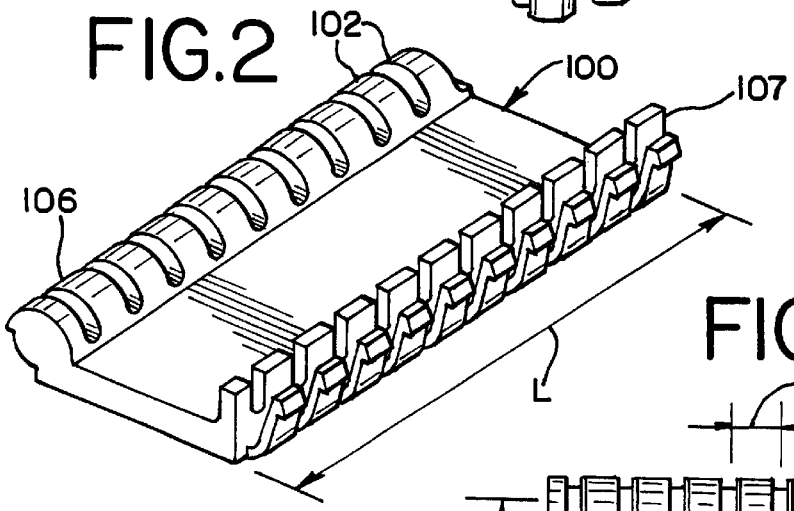
FIG. 2 is a perspective view of a retainer member illustrated in FIG. 1, and taken from the underside thereof.
Figure 3:
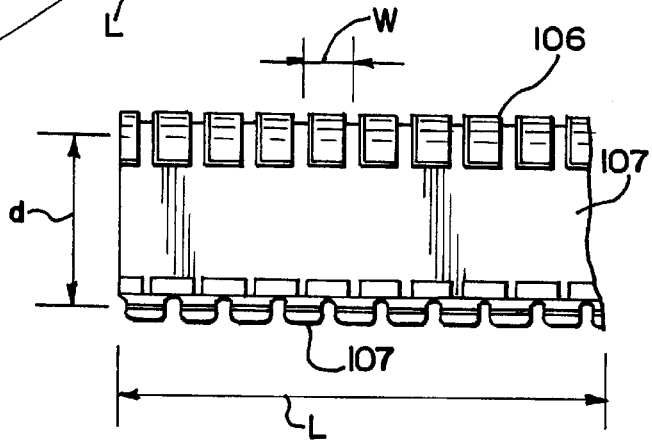
FIG. 3 is a bottom plan view of the retainer member of FIG. 2.
Figure 5:
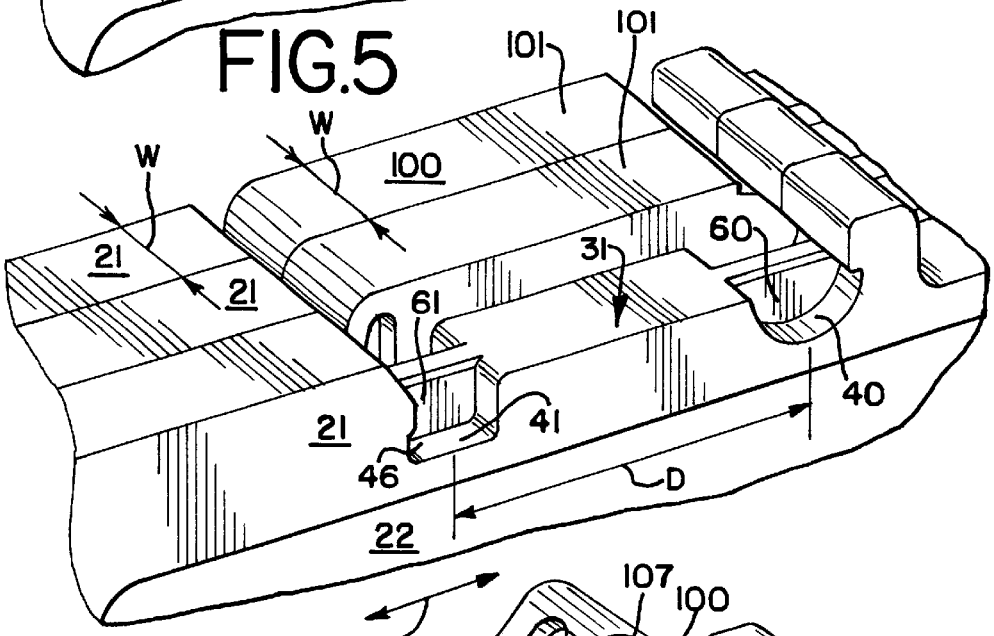
FIG. 5 is a view similar to FIG. 4, but illustrating a retainer member in place thereon with one of the retainer elements at the end of the retainer member removed for clarity.

As shown in FIGS. 2 & 3, the retainer member 100 includes an elongated member 101 having a preselected length L, and which may be considered as incorporating therein, a plurality of individual retainer elements 102, with each retainer element 102 having a preselected width W (FIGS. 3 & 5) that preferably corresponds to the width w (FIG. 1) of the connector element 21. The individual retainer elements 102 that make up the overall retainer member 100 may be separated from each other by a series of intervening indentations 103 so as to facilitate trimming the retainer member 100 when assembling it to a connector assembly 1 0 in order to match the overall width of the connector assembly 10. These indentations are preferably of a depth that will not weaken the structural integrity of the retainer member 100, but are sufficiently deep to facilitate the trimming of a retainer member 100 by an installer.

Turning now to FIG.2, the retainer member 100 can be seen to have two opposing end portions 106, 107 that run lengthwise of the retainer member 100 and which are separated and interconnected by an intervening body portion 108. One end portion 106 serves as a pivoting end and the other end 107 serves as a latching end that holds the retainer member in place on the connector assembly 20. The length L of the retainer member 100 will typically correspond to the overall width $W_T$ of the connector assembly 20.

Figure 4:
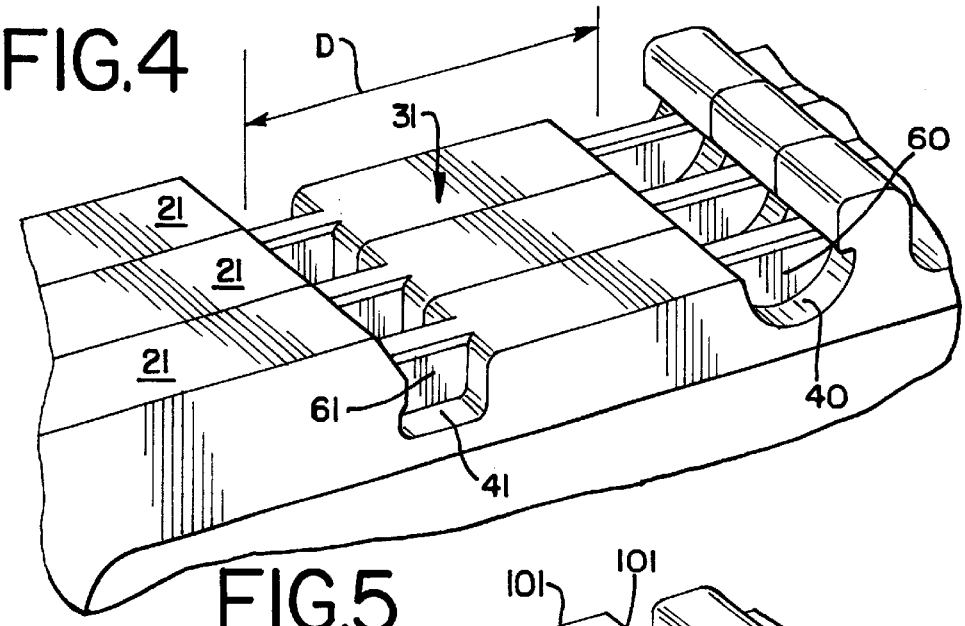
FIG. 4 is an enlarged, detail view of the edge of a portion of the wafer connector assembly illustrating the engagement portions disposed thereon that are engaged by the retainer member of the present invention.

FIG. 4 illustrates one edge 31 of a series of individual connector elements 21 and how the edges 31 of the connector elements 21 are modified to accommodate the retainer member 100. Two different engagement portions 40, 41 are disposed on the edges 31 of the connector elements 21 and are illustrated as cavities that are formed in the connector body portion 22 of each connector element 21. The engagement cavities 40, 41 are spaced apart from each other a predetermined distance D that corresponds to a distance between the end portions 106, 107 of the retainer member 100.

Figure 8:
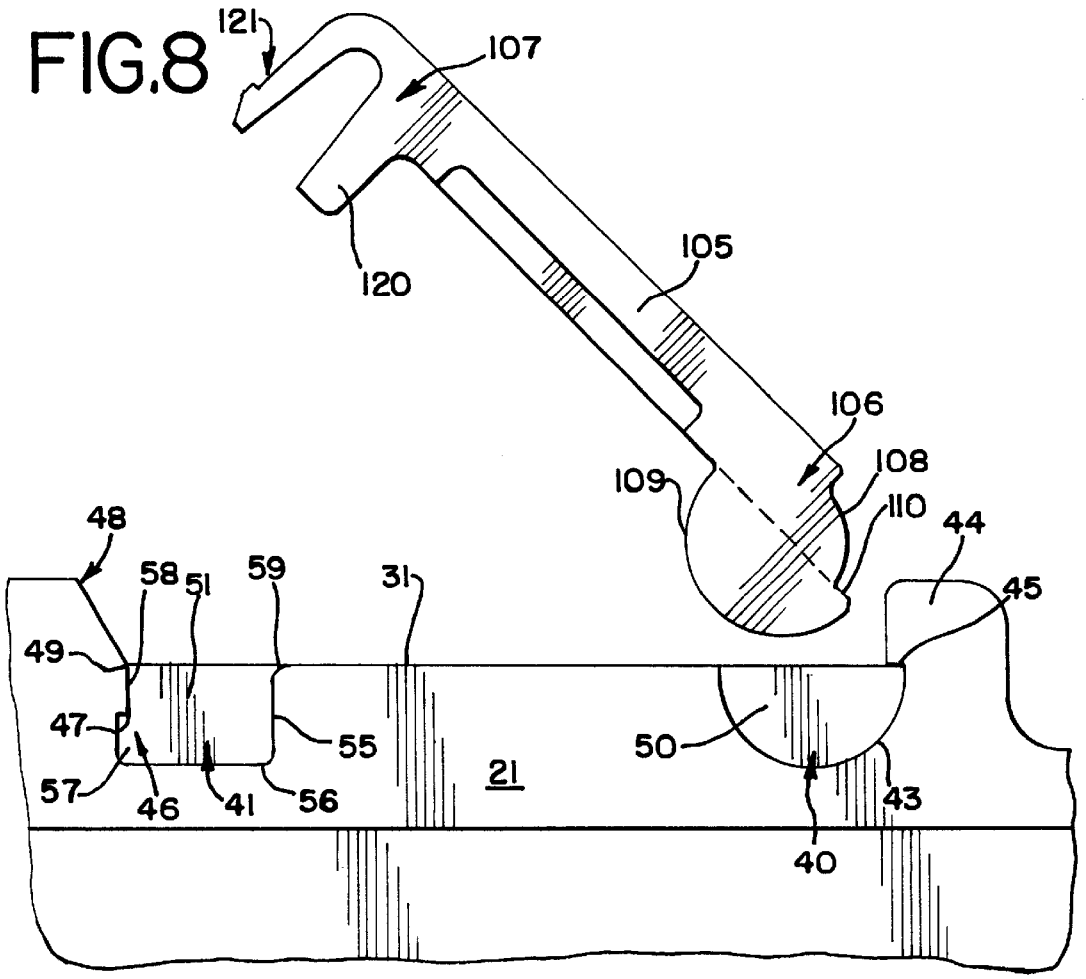
FIG. 8 is an enlarged detail view, taken in elevation, of the retainer element of FIG. 7 and a connector illustrating how the retainer member is inserted into one of the engagement portions of the connector.

FIG. 8 best illustrates the two engagement cavities 40, 41 and their particular structure. The first engagement cavity 40 is rounded, with a generally semi-circular profile defined by a curved sidewall 43 that extends beneath the side edge 31 of the connector element 21. A post portion 44 extends from connector body past the level of the side edge 31 and a portion 43 of the first engagement cavity 40 undercuts the post portion 44 to form a stop surface 45 that faces into the first engagement cavity 40, the purpose of which shall be explained in greater detail below.

The second engagement cavity 41 has an overall rectangular configuration and is also formed in the connector body portion 22. This cavity 41, as with the first engagement cavity 40, also opens along the side edge 31 of the connector element body portion 22. It also has an undercut portion 46 that defines a stop surface 47 that faces into the engagement cavity 41 and which is engaged by the second end 107 of the retainer member 100. The far sidewall 48 of the cavity 41 may have a ramped surface 49 for interacting with the corresponding engagement end 107 of the retainer member 100. Each of the engagement cavities 40, 41 may further have formed therein, a central wall or lug 50, 51, that is preferably centrally disposed therein and which are engaged by the retainer member 100 in the manner described in greater detail below.

Figure 7:
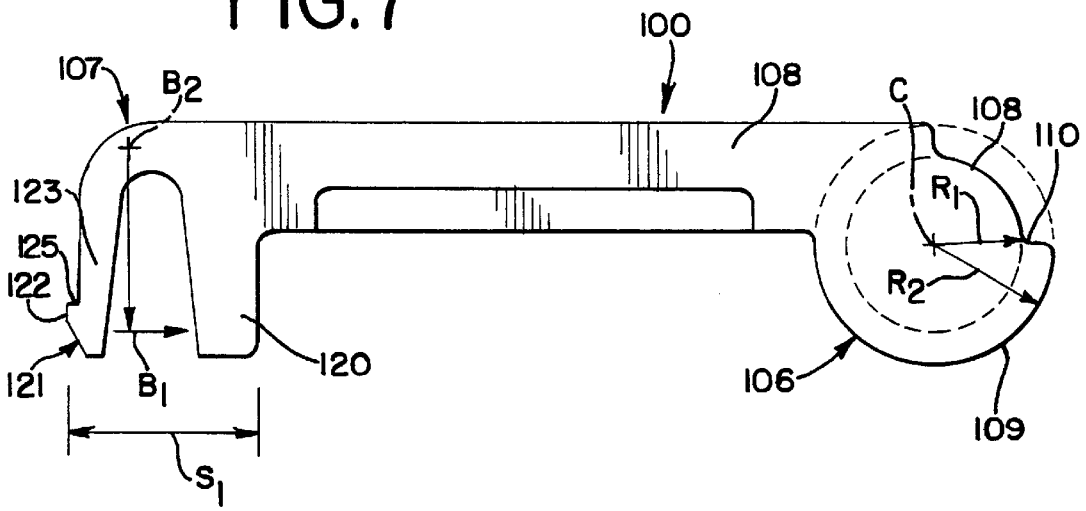
FIG. 7 is an elevational view of one end of the retainer member of FIG. 1.

The retainer member ends 106, 107 are specially configured to engage and interact with the engagement cavities 40, 41 of the connector elements 21. The first end 106 of the retainer member 100, as illustrated in FIG. 7, forms what may be aptly termed as a "pawl" portion that has an overall rounded configuration with two distinct, inner and outer curved surfaces 108, 109 disposed thereon. Each such surface 108, 109 has a distinct radius $R_1$, $R_2$ associated with it from the center point C of the pawl 106 with the radius of the outer surface 109 being greater than the radius of the inner surface 108. This difference in radii defines a shoulder, or stop edge 110, in the pawl portion 106 of the retainer which opposes the shoulder 45 of the first engagement cavity 40 of the connector element 21 and which interconnects the two curved surfaces 108, 109 together.

With this structure, the engagement end 106 is easily insertable into the first engagement cavity 40 and the two curved surfaces 109, 43 permit rotation of the pawl end 106 in the cavity 40. This rotation occurs until the stop edge 110 of the pawl end abuts the stop surface 45. At this full extent of rotation, the second end 107 of the retainer member 100 is itself inserted into its corresponding and opposing second engagement cavity 41.

As seen in FIG. 7, the second engagement end 107 includes two members 120, 121 that extend out from the body portion 105 of the retainer member 100 in a cantilevered fashion. These two members 120, 121 may be considered as flexible members having respective free ends that are spaced apart from each other in a first predetermined spacing $S_1$. The one member 120 acts as an engagement lug that enters the second engagement cavity 41 to engage the adjacent and opposing surface 55 of the cavity 41. This engagement is in the nature of a "slip fit". The engagement of the second engagement end 107 is assisted by a latching member 121.

This latching member 121 is spaced apart from the lug member 120 by the spacing $S_1$ (FIG. 7) and has a body portion 123 that is relatively thin as compared to the thickness of the lug member 120 and thus is more flexible in nature. This spacing $S_1$ is greater than the spacing $S_2$ between the two sidewalls 55, 58 of the second engagement cavity 41 so that when the second engagement end 107 is inserted into the second cavity 41 the latch member 121 is flexed toward the lug member 120 in the direction of the arrow "$B_1$" in FIG. 7. This flexing is somewhat like a pivoting action where the free end of the latching member 121 pivots about a point $B_2$. The latching member 121 preferably has an engagement member, illustrated in FIGS. 7–10, as a hook 122 that protrudes out from the body portion 105 and itself has an engagement surface 125 that faces upwardly with respect to the second cavity 41. The cavity 41 includes an overhanging portion 49 with an engagement shoulder or surface 47 formed thereon that opposes the bottom of the cavity 41.

Figure 6:
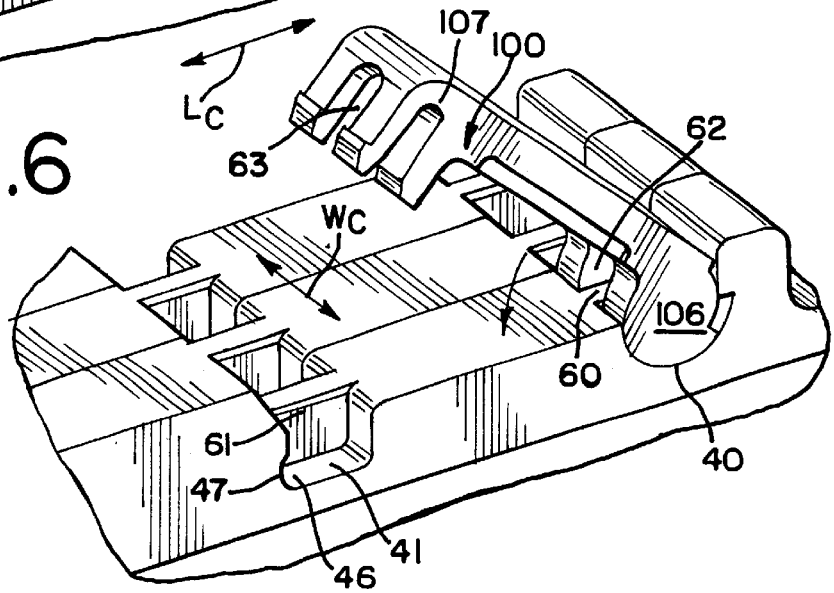
FIG. 6 is a view similar to FIG. 4, but illustrating the insertion of and engagement by one end of a retainer element with one of the engagement portions of an individual connector.
Figure 9:
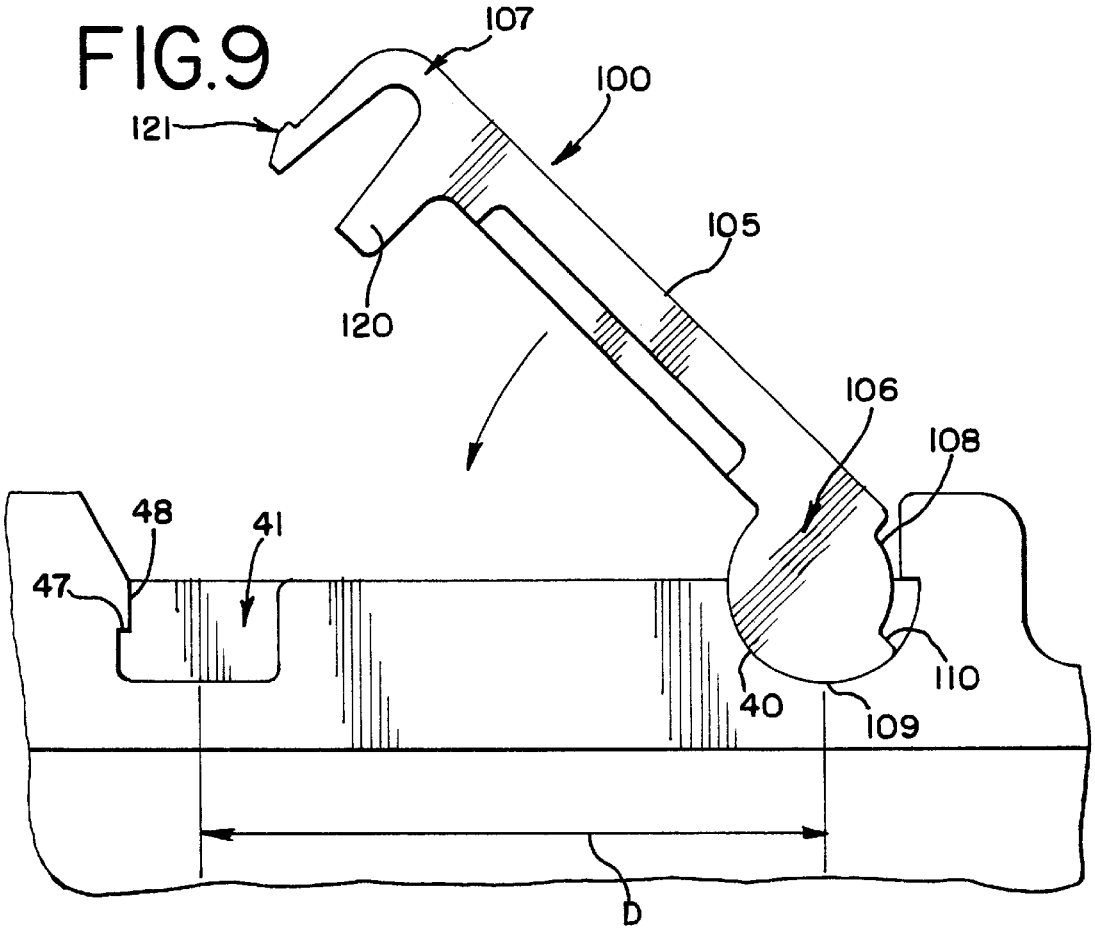
FIG. 9 is the same view as FIG. 8, but illustrating the insertion and beginning rotation of the retainer member retainer element initially inserted into the one engagement portion of the connector; and, FIG. 10 is the same view as FIG. 9, but illustrating the retainer member fully engaged with the connector so that its second engagement end is engaged in the connector second engagement portion.
Figure 10:
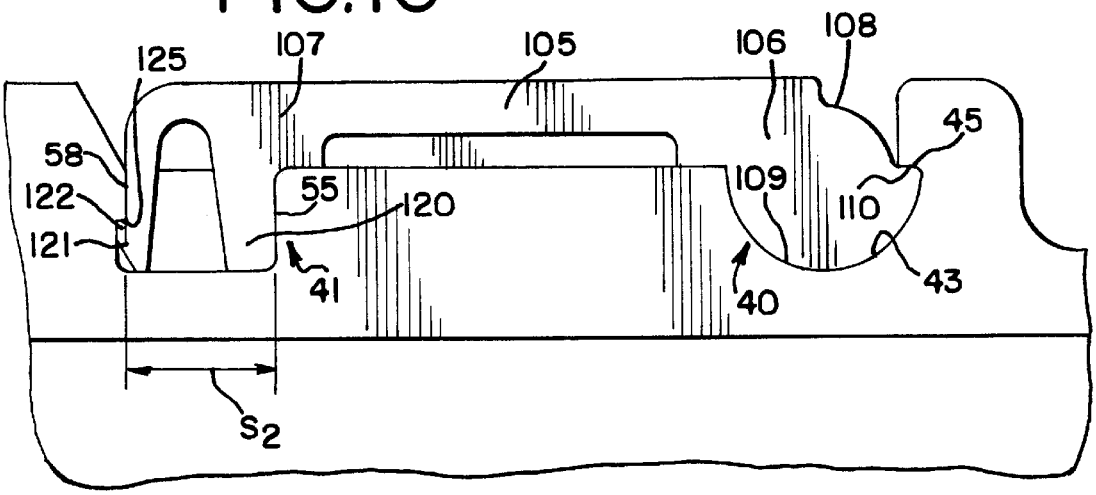

In operation, once the pawl end 106 of the retainer member 100 is located in the first engagement cavity 40, it is rotated in a counter-clockwise direction as shown in FIGS. 6 & 9, thereby bringing the latching end 107 of the retainer member 100 into alignment with and opposition to the second engagement cavity 41. The tops 48, 59 of the sidewalls 49, 55 of the second cavity sidewalls are preferably either rounded or slanted as shown. This configuration 59 facilitates the entry of the lug member 120 of the latching end 107 into the second cavity. Likewise, the slanted surface 8 of the other sidewall 49 serves as a reaction, or cannoning surface that engages the latching member 121, and particularly the hook end 122 thereof. The hook end 122 rides upon this surface 48 which causes the latching member 121 to flex or deflect inwardly (toward the lug member 120) so that it rides along the sidewall 49. The inherent flexibility of this latching member 121 will cause the hook end 122 to spring outwardly when it reaches the undercut 57. At this orientation, the two stop surfaces 47, 125 oppose and engage each other to hold the latching end 107 in place within the second cavity 41. At the same time, the pawl end 106 of the retainer member has been rotated within the first cavity to an extent as shown in FIG. 10, where its shoulder portion 110 abuts against the first cavity stop surface 45.

It can be seen that the retainer member 100 acts as a clip to hold the individual connector elements 21 together as a unified block, or assembly 20 of connector elements. The retainer member 100 not only stiffens the block or unit of connector elements 21, but also aligns the connector elements within the block 20. In this regard, the insert and rotate action of the pawl end 106 serves to initially align the connector elements 21 lengthwise along the unit 20 of connector elements 21 (along the arrow $L_c$ in FIG. 6). This is effected by the contact of the plurality of rounded engagement ends 106 of the retainer member 100. Pairs of the engagement ends 106 will ride on the curved surfaces 43 of the first cavities 40 of each connector element 21. The curvature of the outer sections 109 of the engagement pawl 106 will serve to move individual connector elements 21 slightly forward or backward along the direction $L_c$ of the connector unit 20. This will serve to align the engagement end or terminating face of the mass 20 of connector elements 21 into a planar engagement/terminating face.

In order to align the connector elements 21 widthwise along the unit assembly 20 of connectors, each cavity 40, 41 preferably includes an alignment member, such as the lugs 60, 61 illustrated in FIGS. 2, 3 & 6. These lugs 60, 61 extend lengthwise within their respective cavities 40, 41 and are centrally disposed therein so as to present points of reference, or reaction surfaces on the connector elements 21 that may be engaged by portions of the retainer member 100. In this regard, the corresponding first and second engagement ends 106, 107 are provided with associated slots 62, 63 that are respectively disposed in the pawl and latch ends 106, 107 of the retainer member 100. These slots are best shown in FIGS. 2 and 3 and the manner in which the one slot 62 engages its corresponding lug 62 is shown best in FIG. 6. Each slot 62, 63 is disposed on the retainer member 100, typically on the underside thereof and is aligned with the centers of their opposing cavities 40, 41. The first slots 62, those disposed in the pawl engagement end 106 of the retainer member 100, will assist in aligning the pawl end 106 in the first cavities 40. Insertion of the pawl end and imposition of pressure upon it will cause the slots 62 to engage their opposing lugs 60, thereby exerting an alignment force on the connector elements 21 widthwise of the connector unit 20, or in other words, in a direction transverse to the length of the connector elements 21. Rotation of the pawl end 106 and contact of the latch end 107 with the second cavity 41 will cause a similar alignment force to be exerted on the connector elements 21 in a location that is spaced apart from the first engagement end 106 of the retainer member 100. Thus, it can be appreciated that the retainer member performs an alignment function on the connector elements 21 in two different directions which are generally transverse to each other.

The retainer members 100 have a low profile that permits them to engage the connector elements 21 along the surfaces of their body portions 22 rather than at or along their engagement end portions 70 which extend from the body portions 22 and which are received within an opposing connector 27. The opposing connector 27 typically includes two sidewalls 73, 74 that define a cavity of the connector 27 and which engage the connector elements 21, whether alone, or as a block or unit of connector elements. Because the opposing connector 27 typically has its sidewalls 73, 74 engage the block of connector elements at its engagement end portions 75 (FIG. 1.), the low profile of the retainers 100 of the invention do not require a retention shroud or a separate retainer that encompasses both the block 20 of connector elements 21 and the opposing connector 27 as in the prior art, thereby maintaining the original footprint of the opposing connector on the backplane and not sacrificing additional space thereon to support the connector block. The retainer members 100 are low profile and in essence hug the sides of the connector elements 21 at a location well above the location where the connector elements 21 engage the opposing connector 27, thereby not requiring modification of the opposing connector 27 as in the prior art.

While the preferred embodiment of the invention have been shown and described, it will be apparent to those skilled in the art that changes and modifications may be made therein without departing from the spirit of the invention, the scope of which is defined by the appended claims, such as the pawl surfaces may not need to be completely circular in their curved extent as well as other aspects.

I claim:

1. A connector assembly comprising:

a plurality of individual connector elements, each of the connector elements having a connector body portion, each connector body portion having a plurality of distinct sides, said individual connector includes being arranged in a block of connector in side-by-side order such that said distinct sides of said connector body portions of said individual connectors cooperatively define distinct sides of said block of connectors each of the individual connector element having a plurality of cables extruding from a first one of said connector body portion sides, a plurality of conductive terminals disposed along a second of connector body portion sides, said terminals being electrically connected to said cables;

at least one retainer for retaining said connector modules together as said block, the retainer having a predetermined length and opposing, distinct first and second edges that extend lengthwise of said retainer and which are separated by an intervening body portion of said retainer, each of said retainer first and second edges further respectively including a plurality of discrete first and second engagement elements, pairs of said first and second engagement elements of said retainer engaging respective first and second engagement cavities formed in corresponding sides of each of said individual connector element body portions, so that said individual connector elements are held together as a block.

2. The connector assembly of claim 1, wherein said first engagement elements include pawls and said second engagement elements include latching members.

3. The connector assembly of claim 2, wherein said second engagement elements each include a fixed lug portion extending from said retainer and a deflectable latching arm, also extending from said retainer and spaced apart from said fixed lug portion, said fixed lug portions engaging first sidewalls of said second engagement cavities and said latching arms engaging second sidewalls of said second engagement cavities.

4. The connector assembly of claim 2, wherein each of said connector element first and second engagement cavities includes a wall portion extending lengthwise therethrough, and said retainer first and second engagement elements including slots extending lengthwise therethrough, said first and second engagement cavity wall portions being received within said retainer first and second engagement element slots when said retainer in engaged with said connector elements.

5. The connector assembly of claim 2, wherein said retainer pawls are received within said first engagement cavities and said retainer latching members are received within said second engagement cavities.

6. The connector assembly of claim 5, wherein each of said first engagement cavities includes a curved side wall of a first preselected radius and each of said retainer pawls includes a first curved surface, also of said first preselected radius so that said retainer pawls are rotatable within said first engagement cavities.

7. The connector assets of claim 6, wherein each of said second engagement cavities includes first and second sidewalls, the first sidewall having an undercut portion formed therein, and each of said retainer latching members including a lug and a latching arm, the lug engaging said second engagement cavity second side wall and said latching arm extending into said undercut portion so as to engage said second cavity first sidewall, when said retainer is engaged in place upon said block of connector elements.

8. The connector assembly of claim 6, wherein each of said retainer pawls includes a second curved surface of a second preselected radius that is less than said first preselected radius, said first and second curved surfaces being interconnected by a stop surface.

9. The connector assembly of claim 8, wherein said retainer pawl stop surfaces limit extent of movement of said retainer pawls in said first engagement cavities.

10. The connector assembly of claim 1, further including a second retainer engaging said individual connector elements, said second retainer being spaced apart on said block of connector elements from said retainer.

11. The connector assembly of claim 10, wherein said retainer and second retainer each engage different sides of said connector elements.

12. A connector for use with multi-conductor electrical cables, comprising:

a plurality of individual connector elements assembled together into a mass of connector elements, each of the individual connector elements having a body portion with a cable end into which at least one of said cables extends, a terminal end having a plurality of conductive terminals disposed therealong, said terminals and said cables being electrically connected within said body portions of said connector elements;

a first retainer for holding all of said individual connector elements together in a unitary fashion to form a mass of connector elements in a predetermined relationship to one another with their terminal ends being aligned together to form a terminal end of said connector element mass for connection to an opposing connector;

the body portions of each of said connector elements including first pairs of first and second engagement cavities, the first and second engagement cavities of each connector element being spaced apart from each other a predetermined distance along lengths of said connector element body portions, the first retainer having an elongated body having a length that approximately matches a width of one side of said connector element mass, the body having first and second opposing engagement ends that extend lengthwise of the retainer, said retainer first and second engagement ends each respectively including a plurality of individual first and second engagement members for respectively engaging said connector element first and second engagement cavities, one of said retainer first engagement members being received within one of said connector element first engagement cavities and one of said retainer second engagement members being received within one of said connector element second engagement cavities, said retainer first engagement members being rotatable within said connector element first engagement cavities for an arc length sufficient to bring said retainer second engagement members into engagement with said connector element second engagement cavities.

13. The connector of claim 12, wherein said retainer includes a series of indentations formed on a surface of said retainer body portion, said indentations defining discrete segments of said retainer having a width approximating a width of a connector element.

14. The connector of claim 12, wherein each of said retainer second engagement members include a deflectable latching member extending from said retainer body and each of said connector element second engagement cavities includes a recess disposed in a sidewall thereof, said latching members extending at least partially into said recesses when said retainer second engagement members are fully inserted into said connector element second engagement cavities.

15. The connector of claim 12, further including a second retainer having first and second, opposing engagement ends extending lengthwise of the second retainer, and a plurality of individual first and second engagement members respectively disposed along said retainer first and second engagement ends, said connector elements each including second pairs of first and second engagement cavities disposed thereon, said retainer first and second engagement members respectively engaging said connector element second pairs of said first and second engagement cavities, said first and second pairs of said first and second engagement cavities being spaced apart from each other on said connector elements.

16. The connector of claim 15, wherein said first pairs of said first and second engagement cavities are disposed on one side of said connector elements and said second pairs of said first and second engagement cavities are disposed on another side of said connector elements.

17. The connector of claim 12, wherein said first retainer first engagement members include pawl portions and said first retainer second engagement members include latching members.

18. The connector of claim 17, wherein each of said pawl portions includes at least one curved surface for engaging a portion of said connector element first engagement cavities and wherein each of said latching members includes a fixed lug and a deflectable latching arm, the lugs and arms engaging opposite sides of said connector element second engagement cavity when inserted therein.

19. The connector of claim 17, wherein each of said pawl portions includes at least one curved surface and each of said connector element first engagement cavities includes a complementary curved surface upon which said pawl portions curved surfaces ride upon when said retainer first engagement ends are inserted and rotated within said connector element first engagement cavities.

20. The connector of claim 19, wherein each of said first retainer pawl portions include a stop surface intersecting said curved surface, each of said connector element first engagement cavities including a shoulder, said stop surface engaging said shoulder when said pawl portions are rotated, said stop surface and shoulder cooperatively limiting movement of said pawl portion within said first engagement cavity.

* * * * *